US008882225B2

(12) United States Patent
Iwadate

(10) Patent No.: US 8,882,225 B2
(45) Date of Patent: Nov. 11, 2014

(54) PRINTING APPARATUS, DRIVING APPARATUS, AND DRIVING METHOD

(71) Applicant: Canon Kabushiki Kaisha, Tokyo (JP)

(72) Inventor: Yasuhiro Iwadate, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 13/687,233

(22) Filed: Nov. 28, 2012

(65) Prior Publication Data

US 2013/0194336 A1 Aug. 1, 2013

(30) Foreign Application Priority Data

Jan. 27, 2012 (JP) ..... 2012-015926

(51) Int. Cl.
*B41J 29/38* (2006.01)
*B41J 19/20* (2006.01)
*B41J 23/00* (2006.01)

(52) U.S. Cl.
CPC ..... *B41J 23/00* (2013.01); *B41J 19/202* (2013.01)
USPC ..... 347/14

(58) Field of Classification Search
CPC ..... B41J 19/202
USPC ..... 347/14
See application file for complete search history.

(56) References Cited

U.S. PATENT DOCUMENTS

2006/0076920 A1* 4/2006 Muroi et al. ..... 318/799
2010/0054835 A1* 3/2010 Hayashi ..... 400/76

FOREIGN PATENT DOCUMENTS

JP 2000-232796 A 8/2000
JP 2010-52338 A 3/2010

* cited by examiner

*Primary Examiner* — Stephen Meier
*Assistant Examiner* — Alexander D Shenderov
(74) *Attorney, Agent, or Firm* — Fitzpatrick, Cella, Harper & Scinto

(57) ABSTRACT

A printing apparatus according to the present invention comprises a carriage configured to mount a printhead and reciprocate, a driving unit configured to move the carriage, the driving unit including a motor as a driving source, a measurement unit configured to measure a velocity fluctuation of the carriage, a correction unit configured to correct driving of the motor by correction data to reduce a velocity fluctuation of the carriage arising from cogging of the motor, and a setting unit configured to set a parameter which defines a periodic fluctuation manner of the correction data. The setting unit determines a current preferable value of the parameter based on the velocity fluctuation measured by the measurement unit for a current set value of the parameter, and sets a next set value of the parameter from the determined preferable value.

15 Claims, 14 Drawing Sheets

FIG. 7 kTH

| | |
|---|---|
| PREVIOUS PHASE SET VALUE $\phi n-1$ [° ] | 77 |
| PREVIOUS VELOCITY FLUCTUATION AMOUNT $V(\phi n-1)$ [mm/s$^2$] | 0.11664 |
| CURRENT PREFERABLE VALUE $\phi s$ OF PHASE [° ] | 77 |
| CURRENT PREFERABLE VALUE Vs OF VELOCITY FLUCTUATIONS [mm/s$^2$] | 0.11664 |
| ADJUSTMENT VALUE [° ] | +10 |
| CURRENT PHASE SET VALUE $\phi n$ [° ] | 87 |
| CURRENT VELOCITY FLUCTUATION AMOUNT $V(\phi n)$ [mm/s$^2$] | 0.11293 |
| ESTIMATED OPTIMAL PHASE $\phi op$ [° ] | 95 |

(k+1)TH

| | |
|---|---|
| PREVIOUS PHASE SET VALUE $\phi n-1$ [° ] | 87 |
| PREVIOUS VELOCITY FLUCTUATION AMOUNT $V(\phi n-1)$ [mm/s$^2$] | 0.11293 |
| CURRENT PREFERABLE VALUE $\phi s$ OF PHASE [° ] | 87 |
| CURRENT PREFERABLE VALUE Vs OF VELOCITY FLUCTUATIONS [mm/s$^2$] | 0.11293 |
| ADJUSTMENT VALUE [° ] | +10 |
| CURRENT PHASE SET VALUE $\phi n$ [° ] | 97 |
| CURRENT VELOCITY FLUCTUATION AMOUNT $V(\phi n)$ [mm/s$^2$] | 0.11792 |
| ESTIMATED OPTIMAL PHASE $\phi op$ [° ] | 94 |

(k+2)TH

| | |
|---|---|
| PREVIOUS PHASE SET VALUE $\phi n-1$ [° ] | 97 |
| PREVIOUS VELOCITY FLUCTUATION AMOUNT $V(\phi n-1)$ [mm/s$^2$] | 0.10792 |
| CURRENT PREFERABLE VALUE $\phi s$ OF PHASE [° ] | 97 |
| CURRENT PREFERABLE VALUE Vs OF VELOCITY FLUCTUATIONS [mm/s$^2$] | 0.10792 |
| ADJUSTMENT VALUE [° ] | +10 |
| CURRENT PHASE SET VALUE $\phi n$ [° ] | 107 |
| CURRENT VELOCITY FLUCTUATION AMOUNT $V(\phi n)$ [mm/s$^2$] | 0.12296 |
| ESTIMATED OPTIMAL PHASE $\phi op$ [° ] | 92 |

(k+3)TH

| | |
|---|---|
| PREVIOUS PHASE SET VALUE $\phi n-1$ [° ] | 107 |
| PREVIOUS VELOCITY FLUCTUATION AMOUNT $V(\phi n-1)$ [mm/s$^2$] | 0.12296 |
| CURRENT PREFERABLE VALUE $\phi s$ OF PHASE [° ] | 97 |
| CURRENT PREFERABLE VALUE Vs OF VELOCITY FLUCTUATIONS [mm/s$^2$] | 0.10792 |
| ADJUSTMENT VALUE [° ] | −5 |
| CURRENT PHASE SET VALUE $\phi n$ [° ] | 92 |
| CURRENT VELOCITY FLUCTUATION AMOUNT $V(\phi n)$ [mm/s$^2$] | 0.10905 |
| ESTIMATED OPTIMAL PHASE $\phi op$ [° ] | 94 |

SIGN REVERSAL AND VALUE DECREASE

FIG. 8 kTH

| | |
|---|---|
| PREVIOUS PHASE SET VALUE $\phi n-1$ [° ] | 330 |
| PREVIOUS VELOCITY FLUCTUATION AMOUNT $V(\phi n-1)$ [mm/s$^2$] | 0.44626 |
| CURRENT PREFERABLE VALUE $\phi s$ OF PHASE [° ] | 330 |
| CURRENT PREFERABLE VALUE Vs OF VELOCITY FLUCTUATIONS [mm/s$^2$] | 0.44626 |
| ADJUSTMENT VALUE [° ] | +10 |
| CURRENT PHASE SET VALUE $\phi n$ [° ] | 340 |
| CURRENT VELOCITY FLUCTUATION AMOUNT $V(\phi n)$ [mm/s$^2$] | 0.48712 |
| ESTIMATED OPTIMAL PHASE $\phi op$ [° ] | 213 |

CASE 1

(k+1)TH

| | |
|---|---|
| PREVIOUS PHASE SET VALUE $\phi n-1$ [° ] | 340 |
| PREVIOUS VELOCITY FLUCTUATION AMOUNT $V(\phi n-1)$ [mm/s$^2$] | 0.48712 |
| CURRENT PREFERABLE VALUE $\phi s$ OF PHASE [° ] | 213 |
| CURRENT PREFERABLE VALUE Vs OF VELOCITY FLUCTUATIONS [mm/s$^2$] | UNMEASURED |
| ADJUSTMENT VALUE [° ] | 0 |
| CURRENT PHASE SET VALUE $\phi n$ [° ] | 213 |
| CURRENT VELOCITY FLUCTUATION AMOUNT $V(\phi n)$ [mm/s$^2$] | 0.24047 |
| ESTIMATED OPTIMAL PHASE $\phi op$ [° ] | 209 |

CASE 2

(k+1)TH

| | |
|---|---|
| PREVIOUS PHASE SET VALUE $\phi n-1$ [° ] | 340 |
| PREVIOUS VELOCITY FLUCTUATION AMOUNT $V(\phi n-1)$ [mm/s$^2$] | 0.48712 |
| CURRENT PREFERABLE VALUE $\phi s$ OF PHASE [° ] | 213 |
| CURRENT PREFERABLE VALUE Vs OF VELOCITY FLUCTUATIONS [mm/s$^2$] | UNMEASURED |
| ADJUSTMENT VALUE [° ] | 0 |
| CURRENT PHASE SET VALUE $\phi n$ [° ] | 213 |
| CURRENT VELOCITY FLUCTUATION AMOUNT $V(\phi n)$ [mm/s$^2$] | 0.24047 |
| ESTIMATED OPTIMAL PHASE $\phi op$ [° ] | 127 |

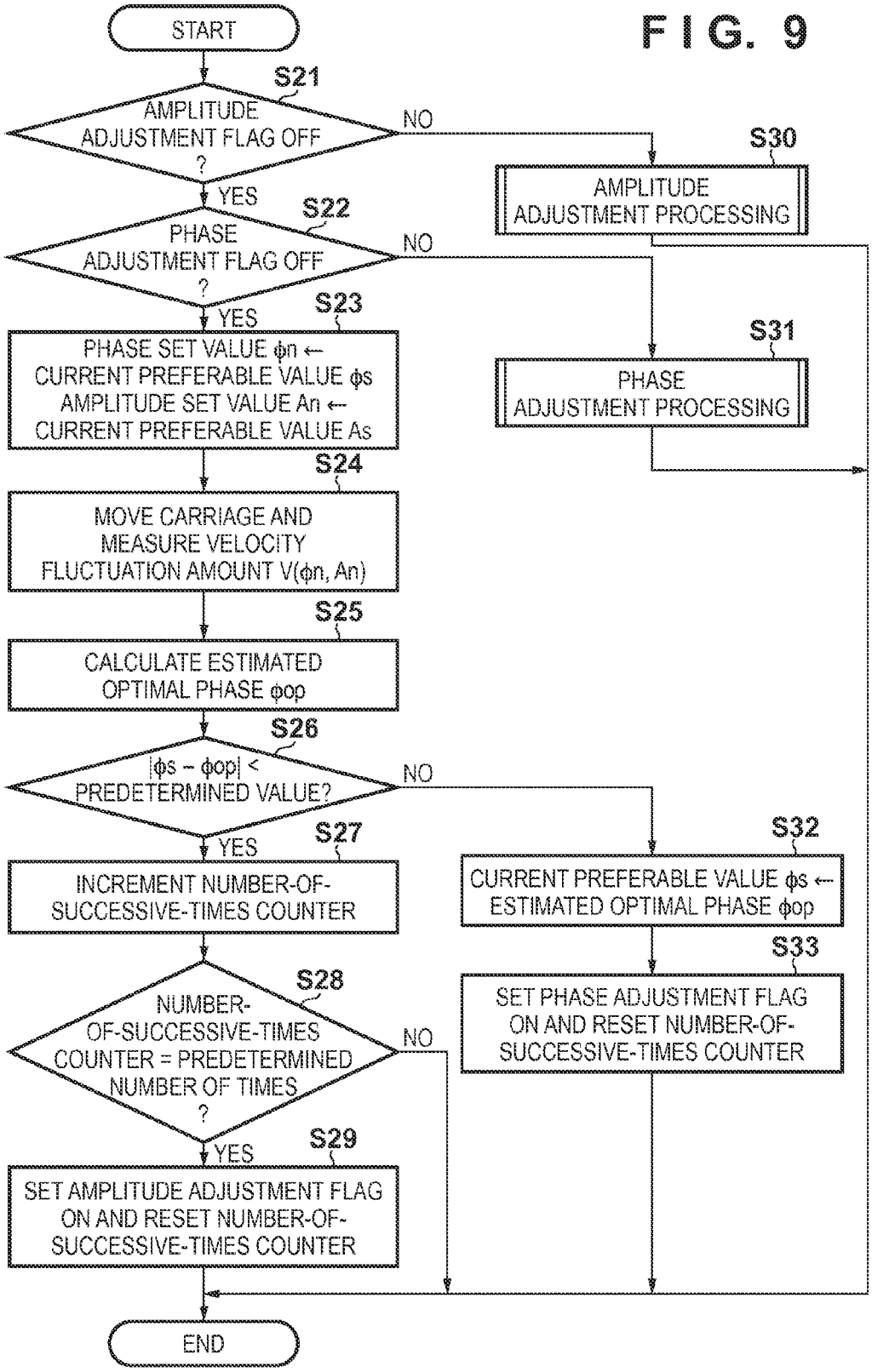
FIG. 9
START
S21
AMPLITUDE ADJUSTMENT FLAG OFF ?
NO
YES
S30
AMPLITUDE ADJUSTMENT PROCESSING
S22
PHASE ADJUSTMENT FLAG OFF ?
NO
YES
S23
PHASE SET VALUE ϕn ← CURRENT PREFERABLE VALUE ϕs
AMPLITUDE SET VALUE An ← CURRENT PREFERABLE VALUE As
S31
PHASE ADJUSTMENT PROCESSING
S24
MOVE CARRIAGE AND MEASURE VELOCITY FLUCTUATION AMOUNT V(ϕn, An)
S25
CALCULATE ESTIMATED OPTIMAL PHASE ϕop
S26
|ϕs − ϕop| < PREDETERMINED VALUE?
NO
YES
S27
INCREMENT NUMBER-OF-SUCCESSIVE-TIMES COUNTER
S32
CURRENT PREFERABLE VALUE ϕs ← ESTIMATED OPTIMAL PHASE ϕop
S33
SET PHASE ADJUSTMENT FLAG ON AND RESET NUMBER-OF-SUCCESSIVE-TIMES COUNTER
S28
NUMBER-OF-SUCCESSIVE-TIMES COUNTER = PREDETERMINED NUMBER OF TIMES ?
NO
YES
S29
SET AMPLITUDE ADJUSTMENT FLAG ON AND RESET NUMBER-OF-SUCCESSIVE-TIMES COUNTER
END

PRINTING APPARATUS, DRIVING APPARATUS, AND DRIVING METHOD

BACKGROUND OF THE INVENTION

1. Field of the Invention

The present invention relates to a technique of suppressing periodic velocity fluctuations of a moving member.

2. Description of the Related Art

In a printing apparatus such as an inkjet printing apparatus, a carriage on which a printhead is mounted is generally moved by a driving mechanism using a motor as a driving source. A motor output contains a so-called torque ripple and cogging torque (to be generically referred to as cogging hereinafter) which are generated in a period corresponding to the motor structure. The cogging causes velocity fluctuations in the carriage in the same period as that of cogging. If printing is performed while velocity fluctuations occur in movement of the carriage, ink discharged from the printhead suffers a periodic landing error. This may lead to poor print quality such as image nonuniformity. A control technique for suppressing the influence of cogging has been proposed (for example, Japanese Patent Laid-Open Nos. 2000-232796 and 2010-052338).

The control method for suppressing the influence of cogging is feedforward control. When suppressing cogging by feedforward control, motor control data is corrected using correction data which is equal in period and amplitude and opposite in phase to cogging. Of these parameters, the cogging generation period is determined by the motor structure, as described above. The amplitude and phase need to be optimized for each product, and this requires a test operation to reciprocate the carriage several times. Even if these parameters are optimized before product shipment, their optimal values vary due to aged deterioration of the product and the like. Thus, the test operation is necessary after purchase by the user. If the test operation requires a dedicated time, the user has to wait because no print operation is performed quickly. Executing the test operation parallel to the print operation or the like may affect the print quality.

SUMMARY OF THE INVENTION

The present invention provides a technique capable of optimizing parameters without ensuring a time dedicated to the test operation.

According to an aspect of the present invention, there is provided a printing apparatus comprising: a carriage configured to mount a printhead and reciprocate; a driving unit configured to move the carriage, the driving unit including a motor as a driving source; a measurement unit configured to measure a velocity fluctuation of the carriage; a correction unit configured to correct driving of the motor by correction data to reduce a velocity fluctuation of the carriage arising from cogging of the motor; and a setting unit configured to set a parameter which defines a periodic fluctuation manner of the correction data, wherein the setting unit determines a current preferable value of the parameter based on the velocity fluctuation measured by the measurement unit for a current set value of the parameter, and sets a next set value of the parameter from the determined preferable value.

Further features of the present invention will become apparent from the following description of exemplary embodiments (with reference to the attached drawings).

BRIEF DESCRIPTION OF THE DRAWINGS

FIG. 7 is a table exemplifying transition of set values and the like;

FIG. 8 is a table exemplifying transition of set values and the like;

FIG. 9 is a flowchart showing another example of parameter setting processing;

DESCRIPTION OF THE EMBODIMENTS

Figure 1:
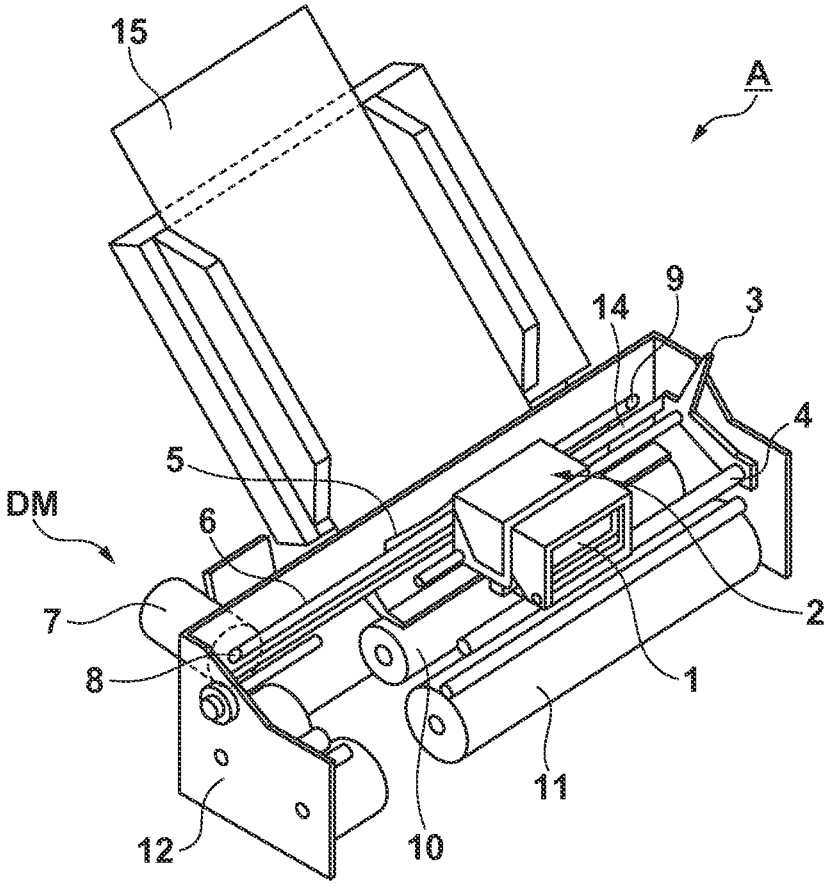
FIG. 1 is a view for explaining a printing apparatus according to an embodiment of the present invention.
Figure 2:
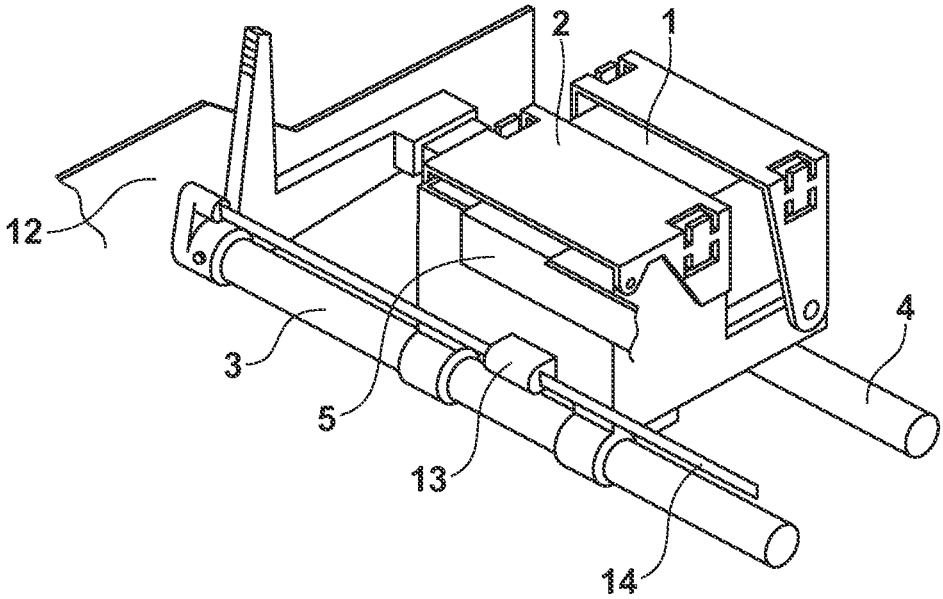
FIG. 2 is a view for explaining a structure around the carriage of the printing apparatus.

FIG. 1 is a view for explaining a printing apparatus A according to an embodiment. The arrangement of the printing apparatus A is partially cut out and shown. FIG. 2 is a view for explaining a structure around a carriage 2. The embodiment will explain a case in which the present invention is applied to an inkjet printing apparatus. However, the present invention is also applicable to a printing apparatus of another type.

Note that "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. "Printing medium" not only includes a paper sheet used in common printing apparatuses, but also broadly includes materials capable of accepting ink, such as cloth, a plastic film, a metal plate, glass, ceramics, wood, and leather.

The printing apparatus A includes the carriage 2 on which a printhead 1 is mounted. The carriage 2 is supported by a main guide rail 3 and sub-guide rail 4. The main guide rail 3 and sub-guide rail 4 support the carriage 2 to freely reciprocate in a direction (main scanning direction) perpendicular to the conveyance direction (sub-scanning direction) of a printing medium 15. Moving the carriage 2 will also be called scanning.

A housing 12 supports the main guide rail 3 and sub-guide rail 4 so that the printhead 1 maintains an almost constant interval with respect to the printing medium 15. The printhead 1 receives ink and discharges it to the printing medium 15, thereby forming an image. As a method of supplying ink to the printhead 1, for example, an ink tank can be mounted on the carriage 2 to supply ink. Alternatively, an ink tank attached to the main body of the printing apparatus A and the printhead can be coupled by a tube or the like to supply ink.

A conveyance roller 10 is driven by a driving unit (not shown) using a motor as a driving source, and conveys the printing medium 15. An ejecting roller 11 ejects a printing medium bearing an image from the apparatus.

The printing apparatus A includes a driving unit DM. The driving unit DM moves the carriage 2. The driving unit DM includes a carriage motor 7 as a driving source. Although the embodiment assumes a DC motor as the carriage motor 7, various motors can be employed. As a power transmission mechanism which transmits the driving force of the carriage motor 7 to the carriage 2, the driving unit DM includes pulleys 8 and 9, and an endless timing belt 6 looped between them. The embodiment adopts the belt transmission mechanism as the power transmission mechanism, but another mechanism can also be adopted.

The pulley 8 is a driving pulley coupled to the carriage motor 7. The pulley 9 is a driven pulley arranged on a side opposite to the pulley 8 in the moving direction of the carriage 2. The traveling direction of the timing belt 6 is parallel to the guide rails 3 and 4, and the carriage 2 is fixed to part of the timing belt 6. By driving the carriage motor 7, the timing belt 6 travels to move the carriage 2.

An encoder sensor 13 which forms a linear encoder is attached to the carriage 2. A linear encoder scale 14 is arranged parallel in the moving direction of the carriage 2. The encoder sensor 13 reads the encoder scale 14 to detect the position of the carriage 2 in the scanning direction. Note that another type of sensor is available as long as it can detect the position of the carriage 2.

A position detection signal output from the encoder sensor 13 is sent to the control unit of the printing apparatus A via a flexible board 5. Based on the position detection signal, the control unit can calculate the position of the carriage 2 in the scanning direction and its moving velocity by counting pulses of the encoder scale 14.

In the printing apparatus A having this arrangement, the carriage 2 moves (scans) on the printing medium 15 conveyed by the conveyance roller 10 in printing. During the movement of the carriage 2, the printhead 1 discharges an ink droplet. When the carriage 2 moves to the side end of the printing medium 15, the conveyance roller 10 conveys the printing medium 15 by a predetermined amount. By repeating this operation, an image is printed on the printing medium 15.

<Control Unit>

Figure 3:
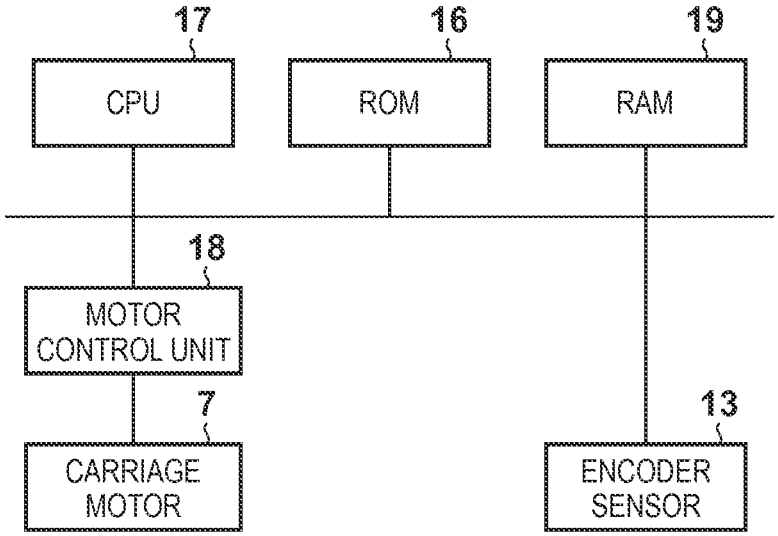
FIG. 3 is a block diagram showing the control unit of the printing apparatus.

FIG. 3 is a block diagram showing the control unit of the printing apparatus A. FIG. 3 shows an arrangement regarding control of the carriage motor 7. A CPU 17 loads a program stored in a ROM 16, and controls the overall printing apparatus A. Processes to be performed by the CPU 17 include image processing, communication with a host computer (not shown), processing based on the detection result of the encoder sensor 13, and control output calculation to a motor control unit 18 which controls the carriage motor 7. A RAM 19 is used to save the result of calculation by the CPU 17, and various data such as print data. Note that the ROM 16 and RAM 19 may be storage devices of another type.

Figure 4:
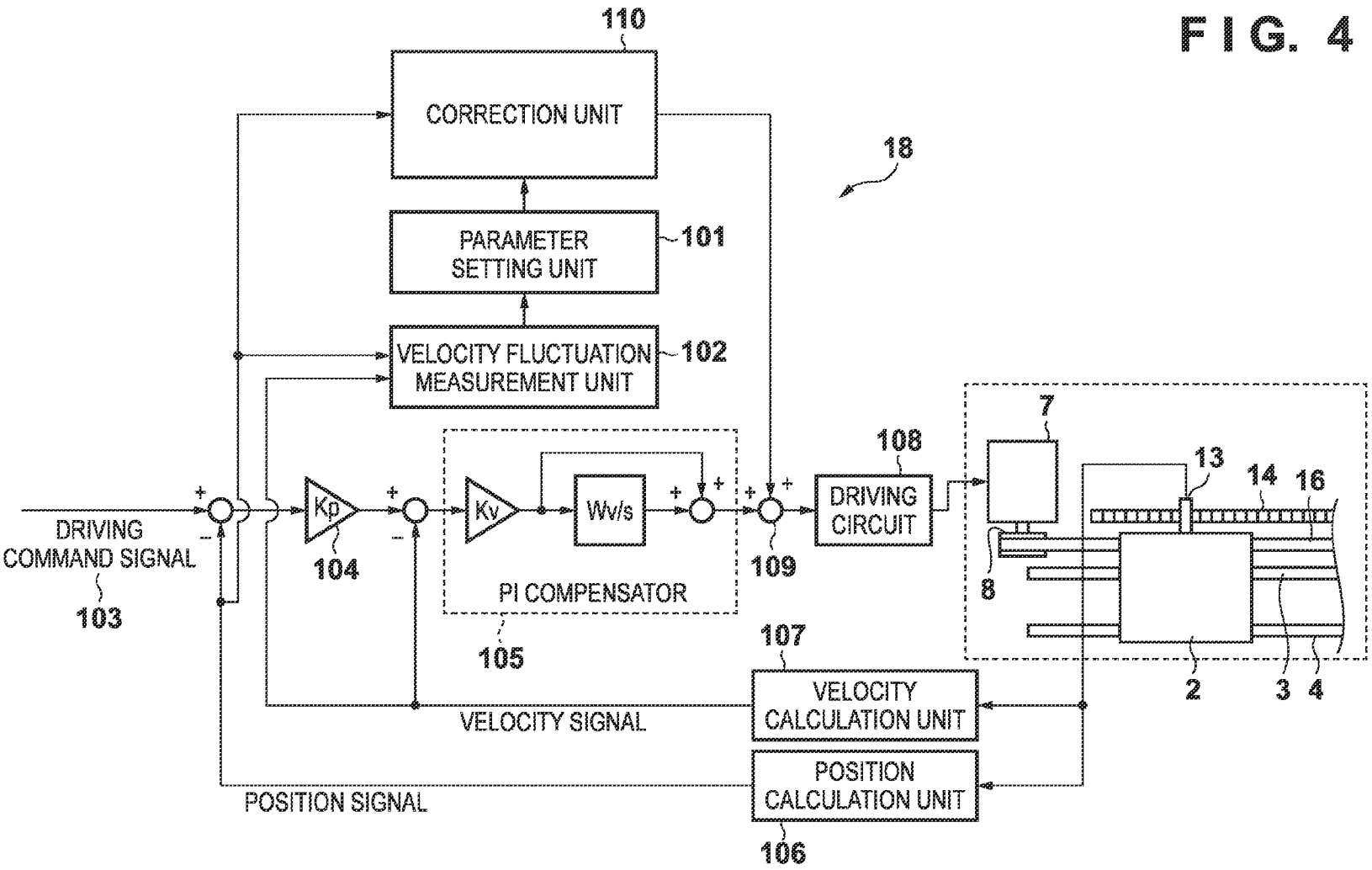
FIG. 4 is a view for explaining a motor control unit.

The motor control unit 18 controls the carriage motor 7 in accordance with a driving command from the CPU 17. FIG. 4 is a view for explaining the motor control unit 18. The motor control unit 18 is formed from, for example, an ASIC (Application Specific Integrated Circuit), and has functions shown in FIG. 4. However, some or all functions of the motor control unit 18 may be executed by the CPU 17.

A driving command signal 103 serving as a control target value represents a driving profile of the carriage 2 that is determined in advance by a program. A position calculation unit 106 and velocity calculation unit 107 calculate the position and velocity of the carriage 2 from signals detected by the encoder sensor 13. Control units 104 and 105 perform feedback control calculation to follow the driving command signal 103 in accordance with the position signal and velocity signal of the carriage 2 that are detected by the encoder sensor 13. Note that the feedback control calculation algorithm is an arbitrary method as long as the carriage 2 is controlled to follow the driving command signal 103.

A correction unit 110 generates, as correction data, data used to drive the carriage motor 7, in order to reduce periodic velocity fluctuations of the carriage 2 in accordance with the position of the carriage 2 mainly due to cogging of the carriage motor 7. An addition unit 109 adds the correction data and an output from the control unit 105, and outputs the sum to a driving circuit 108. By this feedforward control, data for driving the carriage motor 7 is corrected by the correction data. The driving circuit 108 outputs a driving signal to the carriage motor 7.

The correction data is a periodic signal whose value changes periodically in accordance with the position of the carriage 2. The correction data can be calculated according to equation (1):

$$\text{correction data} = \text{amplitude } A \times \sin(2 \times \pi \times \text{carriage position/periodic vibration pitch} + \text{phase } \phi) \quad (1)$$

The correction data is described as a sine wave, but may be a periodic signal formed from a rectangular wave or the like. The carriage position is a position of the carriage 2 that is detected by the encoder sensor 13. The origin of the position signal of the encoder sensor 13 can be set to, for example, a detected home position of the carriage 2.

The periodic vibration pitch is the spatial frequency of cogging of the carriage motor 7. For example, letting N (teeth) be the number of teeth of the pulley 8 and M (mm) be the tooth pitch of the timing belt 6, the feed amount of the timing belt 6 by one rotation of the carriage motor 7 is N×M (mm). When the carriage motor 7 has P ripples per rotation as cogging of the carriage motor 7, the periodic vibration pitch is N×M/P (mm).

The amplitude A is the amplitude of a periodic signal output from the correction unit 110. The amplitude A may be the duty ratio (%) of PWM calculation. The phase $\phi$ is the phase of a periodic signal output from the correction unit 110.

If the correction data becomes equal in amplitude and opposite in phase to cogging generated in the carriage motor 7, velocity fluctuations of the carriage 2 arising from the cogging of the carriage motor 7 can be reduced.

In equation (1), the amplitude A and phase $\phi$ are parameters which define the periodic fluctuation manner of the correction data. The amplitude A and phase $\phi$ change depending on the manufacturing error of the carriage motor 7 and the component error and assembly of the printing apparatus. Therefore, these parameters need to be set for each printing apparatus.

A parameter setting unit 101 sets the parameters in equation (1). The parameters are set based on a velocity fluctuation amount of the carriage 2 that is measured and acquired by a velocity fluctuation measurement unit 102 (velocity fluctuation measurement unit or acquisition unit). The velocity fluctuation measurement unit 102 measures a velocity fluctuation amount of the carriage 2 that is calculated by the velocity calculation unit 107. In the embodiment, the velocity fluctuation amount is the average value of the differences each between a control target value and a velocity of the carriage 2 that is calculated by the velocity calculation unit 107. However, the velocity fluctuation amount may be the maximum value of the differences or the like.

<Parameter Setting Method>

In the embodiment, the present preferable values of the parameters are determined based on the measurement result of the velocity fluctuation amount of the carriage 2 measured at the current set values of the parameters. The next set values of the parameters are set from the determined preferable values.

By adopting this setting method, every set value becomes or comes close to a preferable value. In movement of the carriage 2 for parameter setting, the velocity fluctuation amount can be prevented from becoming a fluctuation amount large enough to affect the print quality. Hence, the parameters can be updated during the print operation. In addition, the preferable values converge to optimal values every time the parameters are set. Thus, the parameters can be optimized without ensuring a time dedicated to the test operation. Examples to be executed by the motor control unit 18 will be explained.

<Setting Example 1>

Figure 5:
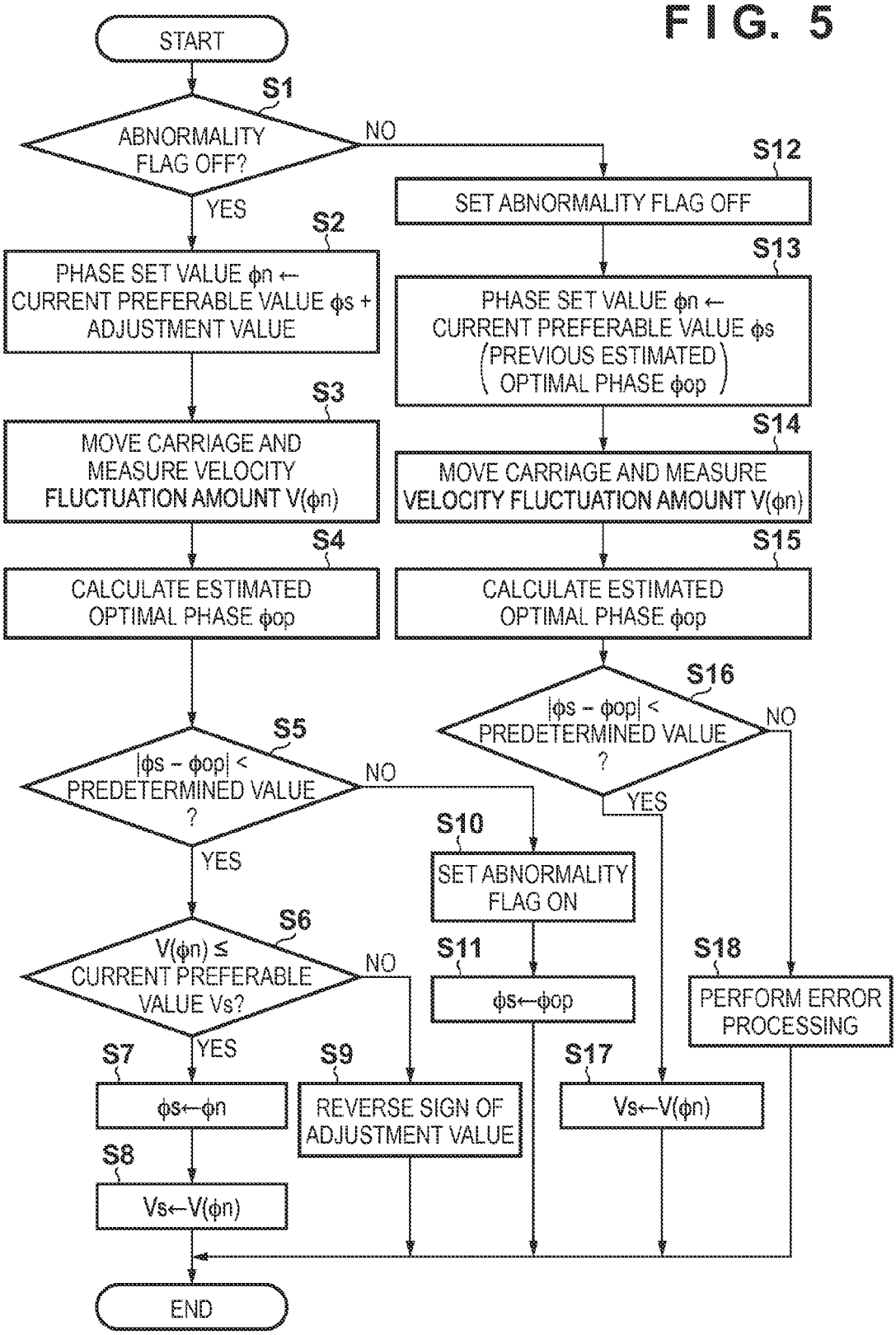
FIG. 5 is a flowchart showing an example of parameter setting processing.

In setting example 1, the amplitude A has a fixed value, and the phase $\phi$ is optimized. FIG. 5 is a flowchart of setting example 1. In setting example 1, every time the carriage 2 is scanned, processing in FIG. 5 is performed once to update the phase $\phi$ and its preferable value. Scanning of the carriage 2 for which the processing in FIG. 5 is performed suffices to be scanning during the print operation. When it is determined to start scanning of the carriage 2, the processing in FIG. 5 can be executed. In each printing scan among a plurality of successive printing scans, the parameter is optimized by performing the processing in FIG. 5. Examples other than the dedicated test scan are various scans regarding the print operation such as paper width scan of the printing medium 15 and a preliminary discharge operation, in addition to the above-mentioned printing scan.

In the following description, $\phi n$ is the current set value of the phase $\phi$, and $\phi n-1$ is the previous set value. $\phi s$ is the present preferable value (also called a current preferable value) of the phase $\phi$. $V(\phi n)$ is a velocity fluctuation amount of the carriage 2 that was measured for the phase set value $\phi n$. A present preferable value (also called a current preferable value) Vs is a velocity fluctuation amount of the carriage 2 that was measured when the phase set value was the current preferable value $\phi s$.

In step S1, it is determined whether an abnormality flag is OFF. The abnormality flag is a flag which is set ON (step S10) when it is estimated that tooth jumping or the like has occurred in the driving unit DM. The abnormality flag is set ON/OFF using, for example, a predetermined storage area of the RAM 19. In the embodiment, processing changes depending on whether the abnormality flag is ON or OFF. If the abnormality flag is OFF, the process advances to step S2; if it is ON, to step S12.

In step S2, the phase set value $\phi n$ is set (setting of the next set value). In this case, the phase set value is obtained by adding an adjustment value to the current preferable value $\phi s$. The adjustment value is defined by a combination of the absolute value and the sign. When the adjustment value is negative, the phase set value $\phi n$ is obtained by subtracting the absolute value of the adjustment value from the current preferable value $\phi s$. The absolute value of the adjustment value can be set to a value falling within the range of 5° to 20°.

In step S3, the carriage 2 is moved (scanned), and the velocity fluctuation amount $V(\phi n)$ is measured from a velocity calculation result corresponding to the position at this time. In movement of the carriage 2, data for driving the carriage motor 7 is corrected based on correction data obtained by substituting the phase set value $\phi n$ set in step S2 into equation (1). Then, the carriage 2 is moved from one end to the other of its moving range. The velocity calculation result corresponding to the position and the measurement value of the velocity fluctuation amount $V(\phi n)$ are saved in, for example, the RAM 19.

In step S4, an estimated optimal phase $\phi op$ of the phase $\phi$ is calculated from velocity fluctuations indicated by the velocity calculation result saved in step S3. This calculation will be explained with reference to FIG. 5. The estimated optimal phase $\phi op$ is a phase $\phi$ which sets the correction data to have a phase opposite (phase shift of 180°) to cogging. Since the printing apparatus A has an arrangement in which the encoder sensor 13 detects cogging generated in the carriage motor 7, the estimated optimal phase $\phi op$ needs to be determined in consideration of a transmission delay.

In the embodiment, calculation of the estimated optimal phase $\phi op$ uses velocity fluctuations in the absence of correction that have been measured in advance, and the velocity fluctuations obtained in step S3. The absence of correction is a case in which correction data is set to 0 and the carriage 2 is moved. Since the velocity of the carriage 2 may fluctuate greatly in the absence of correction, velocity fluctuation data in the absence of correction can be obtained in shipment or the like. Even after shipment, the velocity fluctuation data may be updated at a proper timing. For example, when the abnormality flag becomes ON, the carriage 2 may be automatically moved in the printing apparatus A in a non-printing state to collect velocity fluctuation data.

Figure 6A:
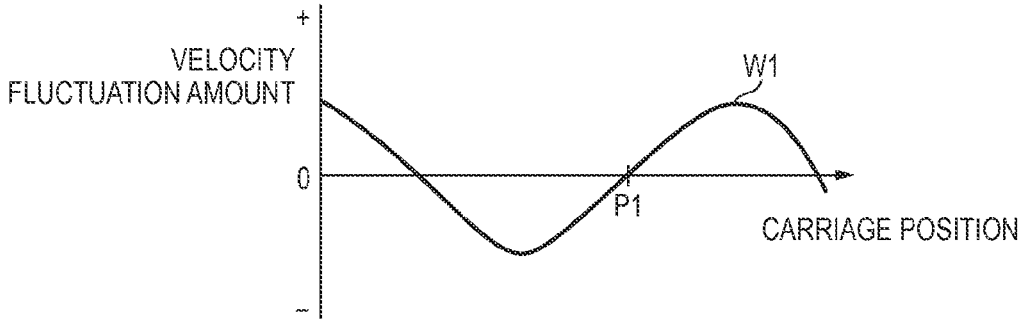
FIGS. 6A to 6C are graphs for explaining an estimated optimal phase calculation method.

FIG. 6A exemplifies a velocity fluctuation waveform W1 of one period in the absence of correction. In the waveform W1, cogging generated in the carriage motor 7 appears as velocity fluctuations of the carriage 2 containing a transmission delay.

Figure 6B:
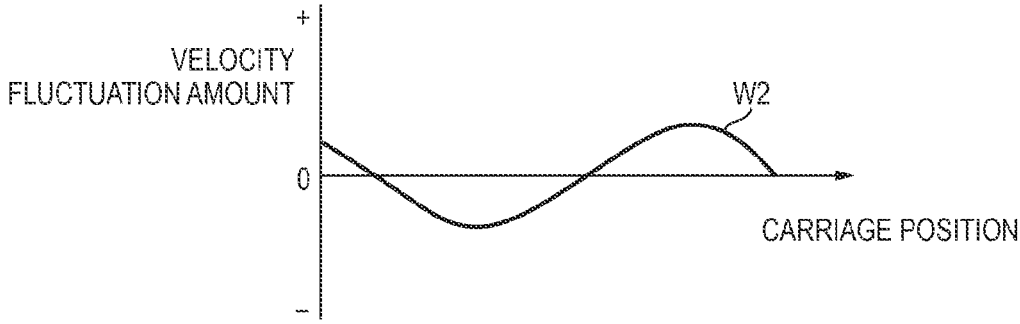

FIG. 6B shows a velocity fluctuation waveform W2 of one period obtained in step S3. In the waveform W2, cogging generated in the carriage motor 7 and the influence of correction data calculated by substituting the phase set value $\phi n$ into equation (1) appear as velocity fluctuations of the carriage 2 containing a transmission delay.

Figure 6C:
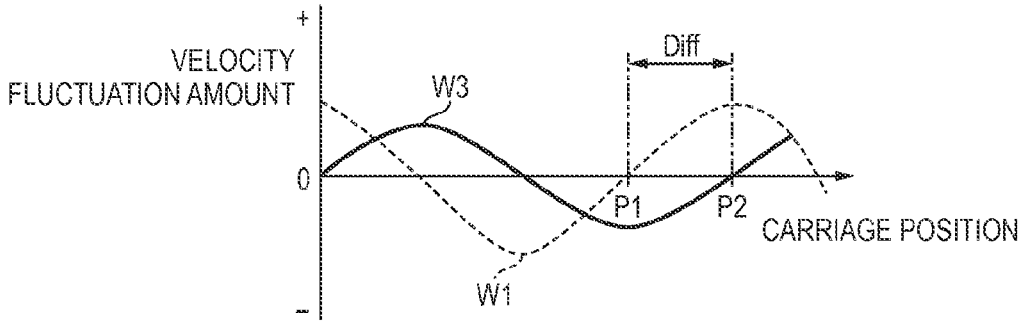

When calculating the estimated optimal phase $\phi op$, the waveform of the difference between the waveforms W1 and W2 is obtained. A waveform W3 in FIG. 6C is the waveform of the difference between the waveforms W1 and W2. In the waveform W3, the influence of correction data calculated by substituting the phase set value $\phi n$ into equation (1) appears as velocity fluctuations of the carriage 2 containing a transmission delay.

From the phase set value $\phi n$ and the phase difference between the waveforms W1 and W3, the estimated optimal phase $\phi op$ which sets the correction data to have a phase opposite to cogging can be calculated. P1 (mm) is a carriage position when no velocity fluctuation appears in the waveform W1. P2 (mm) is a carriage position when no velocity fluctuation appears in the waveform W3. From a difference diff (mm) between the positions P1 and P2, the phase difference between cogging and correction data can be given by $$\text{phase difference (deg)} = \text{diff}/\text{periodic vibration pitch} \times 360$$

From this, $$\text{estimated optimal phase } \phi op \text{ (deg)} = 180 - \text{phase difference}$$

In calculation of the estimated optimal phase $\phi op$, the accuracy can be increased by calculating the estimated optimal phases $\phi op$ in a plurality of periods, and setting their average value as a final estimated optimal phase $\phi op$.

Referring back to FIG. 5, in step S5, it is determined whether the difference (absolute value) between the current preferable value φs and the estimated optimal phase φop is smaller than a predetermined value (phase difference determination). The predetermined value can be set to a value of 60° or smaller in terms of tooth jumping determination or print quality. To strictly determine tooth jumping of the driving unit DM or improve the print quality, the predetermined value can be set to 15° (inclusive) to 45° (inclusive). The embodiment assumes 30°. If the difference is smaller than the predetermined value, the process advances to step S6. If the difference is equal to or larger than the predetermined value, it is considered that an abnormality such as tooth jumping of the driving unit DM has occurred, and the process advances to step S10.

In step S6, it is determined whether the velocity fluctuation amount V(φn) measured in step S3 is equal to or smaller than the current preferable value Vs. That is, it is determined whether velocity fluctuations of the carriage 2 are suppressed by the current phase set value φn. If YES in step S6, the process advances to step S7; if NO, to step S9. In step S7, the current preferable value φs is replaced with the current phase set value φn. Since the current preferable value φs is updated in step S7, the current preferable value φs is replaced with the current velocity fluctuation amount V(φn) in step S8. In step S9, the sign of the adjustment value (adjustment value in step S2) is reversed. In this case, the absolute value of the adjustment value may be reduced in addition to or instead of sign reversal. The current preferable value φs is not updated and remains unchanged.

In the processes of steps S6 to S9, a set value smaller in velocity fluctuations out of the current set value φn and previous set value φn−1 is set as a preferable value. With this setting, the current preferable value φs is replaced with an optimal phase set value φn which decreases the velocity fluctuation amount. Note that the current preferable value φs is not replaced with the estimated optimal phase φop because velocity fluctuations in the estimated optimal phase φop have not actually been measured and whether velocity fluctuations are actually reduced is unknown.

In the processes of steps S6 to S9, addition and subtraction of the adjustment value are not switched when a set value smaller in velocity fluctuations out of the current set value φn and previous set value φn−1 is the current set value, and are switched when it is the previous set value. If velocity fluctuations are suppressed as a consequence, the increase/decrease direction of the phase set value coincides with that of the previous set value in the next setting (step S2) to further suppress velocity fluctuations. If velocity fluctuations worsen, the increase/decrease direction of the phase set value is set to be opposite to that of the previous set value to suppress velocity fluctuations.

In step S10, the abnormality flag is set ON. In the next setting, therefore, the processes in step S2 and subsequent steps after the branch in step S1 are not performed, and processes in step S12 and subsequent steps are performed. In step S11, the current preferable value φs is replaced with the estimated optimal phase φop. When tooth jumping of the driving unit DM or the like has occurred, the current preferable value φs is highly likely to greatly shift from an optimal value, and the same velocity fluctuation result as the previous one is less likely to be obtained. Although whether velocity fluctuations are actually reduced is unknown, the estimated optimal phase φop is set as the current preferable value φs.

In step S12, the abnormality flag is set OFF. In step S13, the phase set value φn is set (setting of the next set value). In this case, the current preferable value φs directly serves as the phase set value φn. That is, the current phase set value φn serves as the estimated optimal phase φop calculated before in step S4 (step S11).

In step S14, the carriage 2 is moved (scanned), and the velocity fluctuation amount V(φn) is measured from a velocity calculation result corresponding to the position at this time. This processing is the same as that in step S3. Data for driving the carriage motor 7 is corrected based on correction data obtained by substituting the phase set value φn set in step S13 into equation (1). Then, the carriage 2 is moved from one end to the other of its moving range. The velocity calculation result corresponding to the position and the measurement value of the velocity fluctuation amount V(φn) are saved in, for example, the RAM 19.

In step S15, the estimated optimal phase φop of the phase φ is calculated from velocity fluctuations indicated by the velocity calculation result saved in step S14. This processing is the same as that in step S4. In step S16, it is determined whether the difference (absolute value) between the current preferable value φs and the estimated optimal phase φop is smaller than a predetermined value (phase difference determination). Although this processing is the same as that in step S5, it is determined whether the difference between the previous estimated optimal phase φop (step S4) and the current estimated optimal phase φop (step S16) is smaller than the predetermined value.

If the difference is smaller than the predetermined value, it is determined that optimization of the phase φ can continue, and the process advances to step S17. In step S17, the current preferable value Vs is replaced with the current velocity fluctuation amount V(φn). In the next setting, the processes in step S2 and subsequent steps are executed again. If the difference is equal to or larger than the predetermined value, the difference has been equal to or larger than the predetermined value successively twice. Thus, it is determined that continuing optimization of the phase φ is difficult, and the process advances to step S18. In step S18, error processing is performed. The contents of error processing include, for example, notification of an error to the user, interruption of the print operation if the print operation is progressing, and no correction (correction data=0). Instead of the error processing, it is also possible to set again the estimated optimal phase φop as the current preferable value φs and repeat the processes in step S13 and subsequent steps.

FIG. 7 exemplifies transition of the respective values when the processing in FIG. 5 is executed a plurality of times successively in every scanning of the carriage 2. In the kth processing, the current preferable value φs is 77°, the adjustment value is +10°, and the current phase set value φn is 77+10=87° by the processing of step S2. The difference between the estimated optimal phase φop and the current preferable value φs is |77−95|=18, and it is determined in step S5 that the difference is smaller than a predetermined value of 30°. The current velocity fluctuation amount V(φn) is smaller than the current preferable value Vs. In the processes of steps S7 and S8, therefore, the current preferable value φs for the next (k+1)th processing is replaced with the current phase set value φn, and the current preferable value Vs is replaced with the current velocity fluctuation amount V(φn).

The values are similarly updated in the (k+1)th processing and (k+2)th processing. However, in the (k+2)th processing, the current velocity fluctuation amount V(φn) becomes larger than the current preferable value Vs. For this reason, the current preferable value φs and current preferable value Vs remain unchanged. The processing of step S9 reverses the sign of the adjustment value. In the example of FIG. 7, the absolute value decreases from 10 to 5. Even in the (k+3)th processing, the current velocity fluctuation amount V(ϕn) becomes larger than the current preferable value Vs. Thus, the current preferable value ϕs and current preferable value Vs remain unchanged. The fact that the current velocity fluctuation amount V(ϕn) does not become smaller than the current preferable value Vs means that the current preferable value ϕs is close to the optimal value.

FIG. 8 exemplifies another transition. In the kth processing, the current preferable value ϕs is 330°, the adjustment value is +10°, and the current phase set value ϕn is 330+10=340° by the processing of step S2. The difference between the estimated optimal phase ϕop and the current preferable value ϕs is |330−213|=117, and it is determined in step S5 that the difference is equal to or larger than the predetermined value of 30°. In the processing of step S10, the abnormality flag is set ON, and the current preferable value ϕs is replaced with the estimated optimal phase ϕop.

In the (k+1)th processing, for case 1, the current phase set value ϕn becomes a current preferable value ϕs of 213° by the processing of step S13. The difference between the estimated optimal phase ϕop and the current preferable value ϕs is |213−209|=4, and it is determined in step S16 that the difference is smaller than the predetermined value of 30°. In the processing of step S17, the current preferable value Vs is replaced with the current velocity fluctuation amount V(ϕn). In the next ((k+2)th) processing, the processes in step S2 and subsequent steps are performed.

For case 2, the current phase set value ϕn becomes the current preferable value ϕs of 213° by the processing of step S13. The difference between the estimated optimal phase ϕop and the current preferable value ϕs is |213−127|=86, and it is determined in step S16 that the difference is equal to or larger than the predetermined value of 30°. Hence, the error processing in step S18 is executed.

<Setting Example 2>

Figure 10:
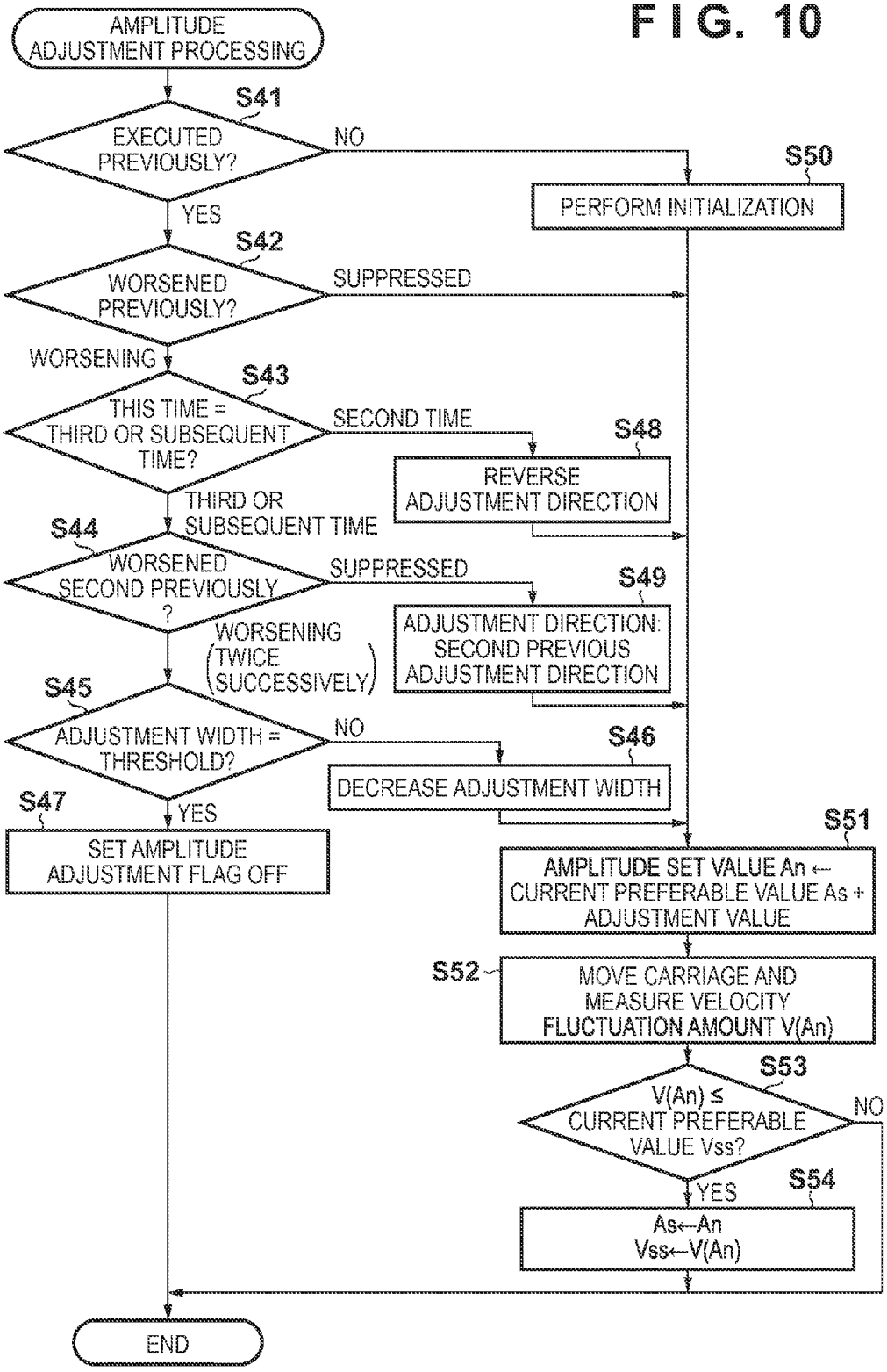
FIG. 10 is a flowchart showing an example of amplitude adjustment processing.
Figure 11:
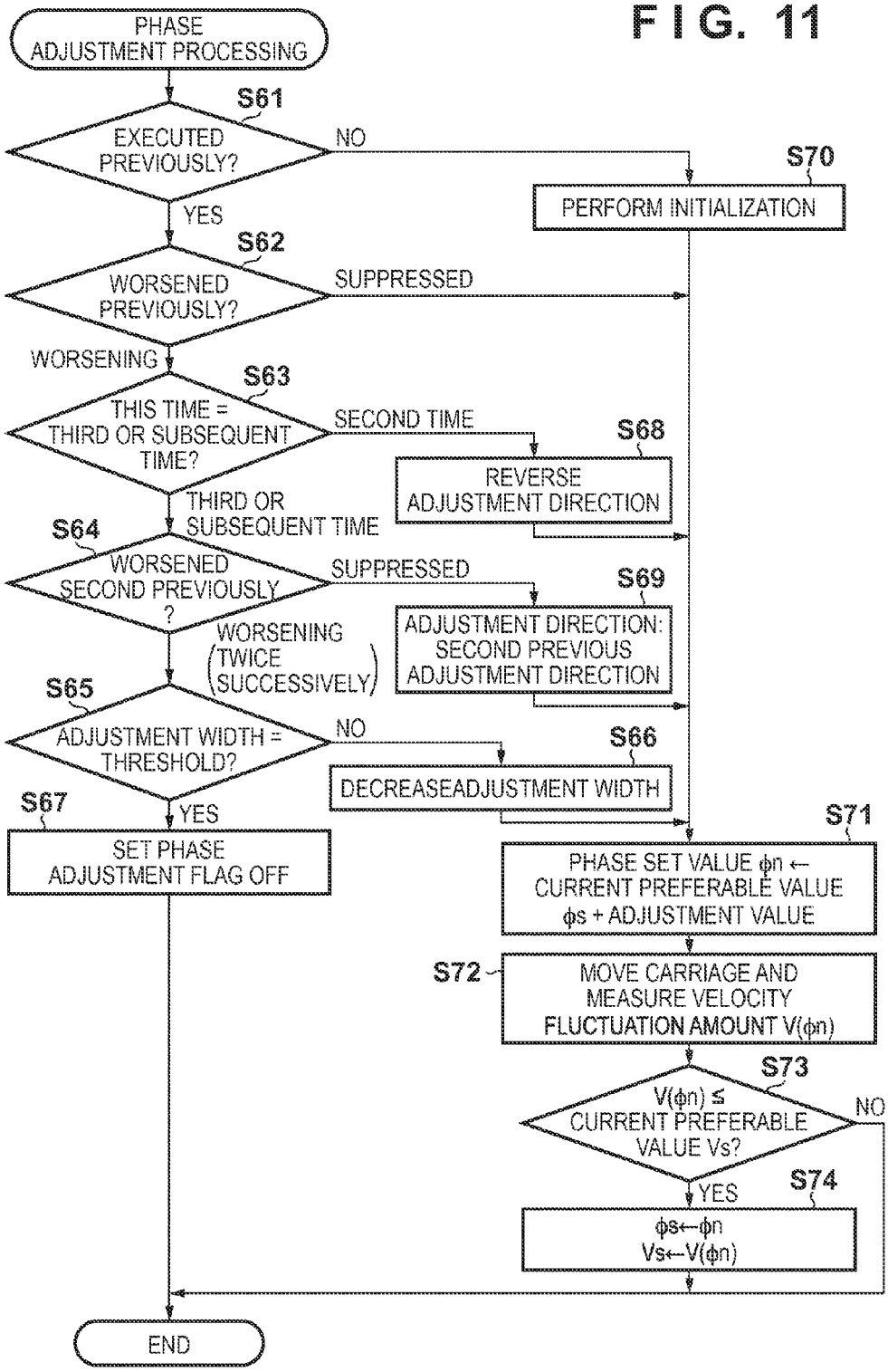
FIG. 11 is a flowchart showing an example of phase adjustment processing.

In setting example 2, both the amplitude A and phase ϕ are optimized. FIGS. 9 to 11 are flowcharts of setting example 2. In setting example 2, every time the carriage 2 is scanned, processes in FIGS. 9 to 11 are performed once to update the amplitude A and phase ϕ and their preferable values. A difference from setting example 1 will be explained. The meanings of the terms and application of examples, modifications, and the like are the same as those in setting example 1, unless otherwise specified. In the following description, An is the current set value of the amplitude A, and An−1 is the previous set value. As is the present preferable value (also called a current preferable value) of the amplitude A. V(ϕn, An) is a velocity fluctuation amount of the carriage 2 that was measured for the phase set value ϕn and amplitude set value An. A present preferable value (also called a current preferable value) Vss is a velocity fluctuation amount of the carriage 2 that was measured when the amplitude set value was the current preferable value As.

In step S21, it is determined whether an amplitude adjustment flag is OFF. If YES in step S21, the process advances to step S22; if NO, to step S30 to perform amplitude adjustment processing. The amplitude adjustment flag is a flag which is set ON (step S29) when adjusting the amplitude A. The amplitude adjustment flag is set ON/OFF using, for example, a predetermined storage area of the RAM 19. Details of the amplitude adjustment processing will be described later.

In step S22, it is determined whether a phase adjustment flag is OFF. If YES in step S22, the process advances to step S23; if NO, to step S31 to perform phase adjustment processing. The phase adjustment flag is a flag which is set ON (step S33) when adjusting the phase ϕ. The phase adjustment flag is set ON/OFF using, for example, a predetermined storage area of the RAM 19. Details of the phase adjustment processing will be described later.

In step S23, the phase set value ϕn and amplitude set value An are set (setting of the next values). In this case, the current preferable values ϕs and As are set as the phase set value ϕn and amplitude set value An, respectively. In step S24, the carriage 2 is moved (scanned), and the velocity fluctuation amount V(ϕn, An) is measured from a velocity calculation result corresponding to the position at this time. In movement of the carriage 2, data for driving the carriage motor 7 is corrected based on correction data obtained by substituting the phase set value ϕn and amplitude set value An set in step S23 into equation (1). Then, the carriage 2 is moved from one end to the other of its moving range. The velocity calculation result corresponding to the position and the measurement value of the velocity fluctuation amount V(ϕn, As) are saved in, for example, the RAM 19.

In step S25, the estimated optimal phase ϕop is calculated based on the result of step S24. This processing is the same as that in step S4. In step S26, it is determined whether the difference (absolute value) between the current preferable value ϕs and the estimated optimal phase ϕop is smaller than a predetermined value (phase difference determination). This processing is the same as that in step S5. If the difference is smaller than the predetermined value, the process advances to step S27. If the difference is equal to or larger than the predetermined value, it is considered that an abnormality such as tooth jumping of the driving unit DM has occurred, and the process advances to step S32.

In step S27, a number-of-successive-times counter is incremented by one. The number-of-successive-times counter is, for example, a software counter whose count value is stored in the RAM 19. The number-of-successive-times counter counts the number of successive times by which it is determined in step S26 that the difference is smaller than the predetermined value.

In step S28, it is determined whether the count value of the number-of-successive-times counter has reached a predetermined number of times. The predetermined number of times is, for example, 7. If YES in step S28, it is determined that the set value of the phase ϕ is stable, and the process advances to step S29. In step S29, the amplitude adjustment flag is set ON, and the number-of-successive-times counter is reset (0). In step S32, the current preferable value ϕs is replaced with the estimated optimal phase ϕop. In step S33, the phase adjustment flag is set ON, and the number-of-successive-times counter is reset.

In the processes of steps S23 to S29, S32, and S33, when an abnormality such as tooth jumping of the driving unit DM has occurred, the phase set value ϕn and current preferable value ϕs are adjusted; otherwise, they remain unchanged. If this state continues a plurality of times (predetermined number of times), it is determined that the current preferable value ϕs is close to the optimal value, and the amplitude adjustment processing (step S30) is performed. When the phase ϕ shifts due to generation of an abnormality such as tooth jumping of the driving unit DM, the phase ϕ is adjusted by the phase adjustment processing (step S31), and then the amplitude adjustment processing (step S30) is performed. The phase adjustment processing is not frequently performed, and only when the phase ϕ shifts greatly, it is optimized. When processing of setting example 2 is performed in the print operation, the influence on the print operation can be further reduced. If the phase ϕ is proper to a certain degree, the influence of velocity fluctuations on the print quality is considered to be little.

The amplitude adjustment processing in step S30 is processing of fixing the phase set value ϕn to the current preferable value ϕs and adjusting the set value of the amplitude A. The phase adjustment processing in step S31 is processing of fixing the amplitude set value An to the current preferable value As and adjusting the set value of the phase ϕ.

FIG. 10 is a flowchart showing the amplitude adjustment processing. In step S41, it is determined whether the amplitude adjustment processing was executed previously (whether amplitude adjustment processing is to be executed for the first time after the amplitude adjustment flag is set ON). If YES in step S41, the process advances to step S42; if NO, to step S50. In step S50, initialization is performed. In this case, the adjustment width of the adjustment value and its positive or negative initial value are set. In step S51, the amplitude set value An is set (setting of the next set value). A value obtained by adding the adjustment value to the current preferable value As is set as the amplitude set value. The adjustment value is defined by a combination of the absolute value and the sign. When the adjustment value is negative, the amplitude set value An is obtained by subtracting the absolute value of the adjustment value from the current preferable value As. In this example, the absolute value of the adjustment value is "absolute value=adjustment width n×current preferable value As". The adjustment width n has an initial value of, for example, 0.004, and gradually decreases by processing of step S46 (to be described later).

In step S52, the carriage 2 is moved (scanned), and the velocity fluctuation amount is measured from a velocity calculation result corresponding to the position at this time. This processing is the same as that in step S3. In movement of the carriage 2, data for driving the carriage motor 7 is corrected based on correction data obtained by substituting the current preferable value ϕs and the amplitude set value An set in step S51 into equation (1). Then, the carriage 2 is moved from one end to the other of its moving range. V(An) is a measured velocity fluctuation amount. The velocity calculation result corresponding to the position and the measurement value of the velocity fluctuation amount V(An) are saved in, for example, the RAM 19.

In step S53, it is determined whether the velocity fluctuation amount V(An) measured in step S52 is equal to or smaller than the current preferable value Vss. That is, it is determined whether velocity fluctuations of the carriage 2 are suppressed by the current amplitude set value An. If YES in step S53, the process advances to step S54; if NO, the processing for one unit ends.

In step S54, the current preferable value As is replaced with the current amplitude set value An, and the current preferable value Vss is replaced with the current velocity fluctuation amount V(An). In the processes of steps S53 and S54, a set value smaller in velocity fluctuations out of the current set value An and previous set value An−1 is set as a preferable value. With this setting, the current preferable value As is replaced with an optimal amplitude set value An which decreases the velocity fluctuation amount.

In step S42, it is determined whether velocity fluctuations of the carriage 2 worsened as a result of previous amplitude adjustment processing. If velocity fluctuations worsened, the process advances to step S43; otherwise, to step S51. In step S43, it is determined whether the current amplitude adjustment processing is the third or subsequent amplitude adjustment processing. If the current amplitude adjustment processing is the second one, the process advances to step S48. The process advances to step S48 when velocity fluctuations worsened as a result of the first amplitude adjustment. Thus, the sign of the adjustment value is reversed in step S48. When the sign of the initial value of the adjustment value is positive, it is reversed into a negative one. Then, the process advances to step S51.

In step S44, it is determined whether velocity fluctuations of the carriage 2 worsened as a result of second previous amplitude adjustment processing. If velocity fluctuations worsened twice successively, the process advances to step S45; if velocity fluctuations were suppressed by the second previous amplitude adjustment processing, to step S49. In step S49, the sign of the adjustment value is set to be the same as that in the second previous amplitude adjustment processing. That is, the adjustment value is returned to a direction in which velocity fluctuations were suppressed. The process then advances to step S51.

In step S45, it is determined whether the adjustment width n has reached a threshold. If YES in step S45, the process advances to step S47; if NO, to step S46. In step S46, the adjustment width n is decreased, and then the process advances to step S51. The fact that velocity fluctuations worsened twice successively means that the adjustment value is close to an optimal value. Accordingly, the absolute value of the adjustment value is decreased. In step S47, the amplitude adjustment flag is set OFF. Then, the amplitude adjustment processing ends.

In step S46, the adjustment width n can be decreased stepwise from, for example, the initial value of 0.004→0.002→0.001. The threshold in step S45 is set to 0.001. If velocity fluctuations worsen even at the adjustment width n of 0.001, the current preferable value As is regarded as an almost optimal value, and the amplitude adjustment processing ends.

FIG. 11 is a flowchart showing the phase adjustment processing. The phase adjustment processing in FIG. 11 has the same processing contents as those of the amplitude adjustment processing in FIG. 10.

In step S61, it is determined whether the phase adjustment processing was executed previously (whether phase adjustment processing is to be executed for the first time after the phase adjustment flag is set ON). If YES in step S61, the process advances to step S62; if NO, to step S70. In step S70, initialization is performed. In this case, the adjustment width of the adjustment value and its positive or negative initial value are set.

In step S71, the phase set value ϕn is set (setting of the next set value). A value obtained by adding the adjustment value to the current preferable value ϕs is set as the phase set value. The adjustment value is defined by a combination of the absolute value and the sign. When the adjustment value is negative, the phase set value ϕn is obtained by subtracting the absolute value of the adjustment value from the current preferable value ϕs. In this example, the absolute value of the adjustment value is "absolute value=adjustment width m". The adjustment width m has an initial value of, for example, 20°, and gradually decreases by processing of step S66 (to be described later).

In step S72, the carriage 2 is moved (scanned), and the velocity fluctuation amount is measured from a velocity calculation result corresponding to the position at this time. This processing is the same as that in step S3. In movement of the carriage 2, data for driving the carriage motor 7 is corrected based on correction data obtained by substituting the current preferable value As and the phase set value ϕn set in step S71 into equation (1). Then, the carriage 2 is moved from one end to the other of its moving range. V(ϕn) is a measured velocity fluctuation amount. The velocity calculation result corresponding to the position and the measurement value of the velocity fluctuation amount V(ϕn) are saved in, for example, the RAM 19.

In step S73, it is determined whether the velocity fluctuation amount V(ϕn) measured in step S72 is equal to or smaller than the current preferable value Vs. That is, it is determined whether velocity fluctuations of the carriage 2 are suppressed by the current phase set value ϕn. If YES in step S73, the process advances to step S74; if NO, the processing for one unit ends.

In step S74, the current preferable value ϕs is replaced with the current phase set value ϕn, and the current preferable value Vs is replaced with the current velocity fluctuation amount V(ϕn). In the processes of steps S73 and S74, a set value smaller in velocity fluctuations out of the current set value ϕn and previous set value ϕn−1 is set as a preferable value. With this setting, the current preferable value ϕs is replaced with an optimal phase set value ϕn which decreases the velocity fluctuation amount.

In step S62, it is determined whether velocity fluctuations of the carriage 2 worsened as a result of previous phase adjustment processing. If velocity fluctuations worsened, the process advances to step S63; otherwise, to step S71. In step S63, it is determined whether the current phase adjustment processing is the third or subsequent phase adjustment processing. If the current phase adjustment processing is the second one, the process advances to step S68. The process advances to step S68 when velocity fluctuations worsened as a result of the first phase adjustment. Thus, the sign of the adjustment value is reversed in step S68. When the sign of the initial value of the adjustment value is positive, it is reversed into a negative one. After that, the process advances to step S71.

In step S64, it is determined whether velocity fluctuations of the carriage 2 worsened as a result of second previous phase adjustment processing. If velocity fluctuations worsened twice successively, the process advances to step S65; if velocity fluctuations were suppressed by the second previous phase adjustment processing, to step S69. In step S69, the sign of the adjustment value is set to be the same as that in the second previous phase adjustment processing. That is, the adjustment value is returned to a direction in which velocity fluctuations were suppressed. The process then advances to step S71.

In step S65, it is determined whether the adjustment width m has reached a threshold. If YES in step S65, the process advances to step S67; if NO, to step S66. In step S66, the adjustment width m is decreased, and then the process advances to step S71. The fact that velocity fluctuations worsened twice successively means that the adjustment value is close to an optimal value. As a result, the absolute value of the adjustment value is decreased. In step S67, the phase adjustment flag is set OFF. Then, the phase adjustment processing ends.

In step S66, the adjustment width m can be decreased stepwise from, for example, the initial value of 20°→10°→5°. The threshold in step S65 is set to 5°. If velocity fluctuations worsen even at the adjustment width m of 5°, the current preferable value ϕs is regarded as an almost optimal value, and the phase adjustment processing ends.

Figure 12:
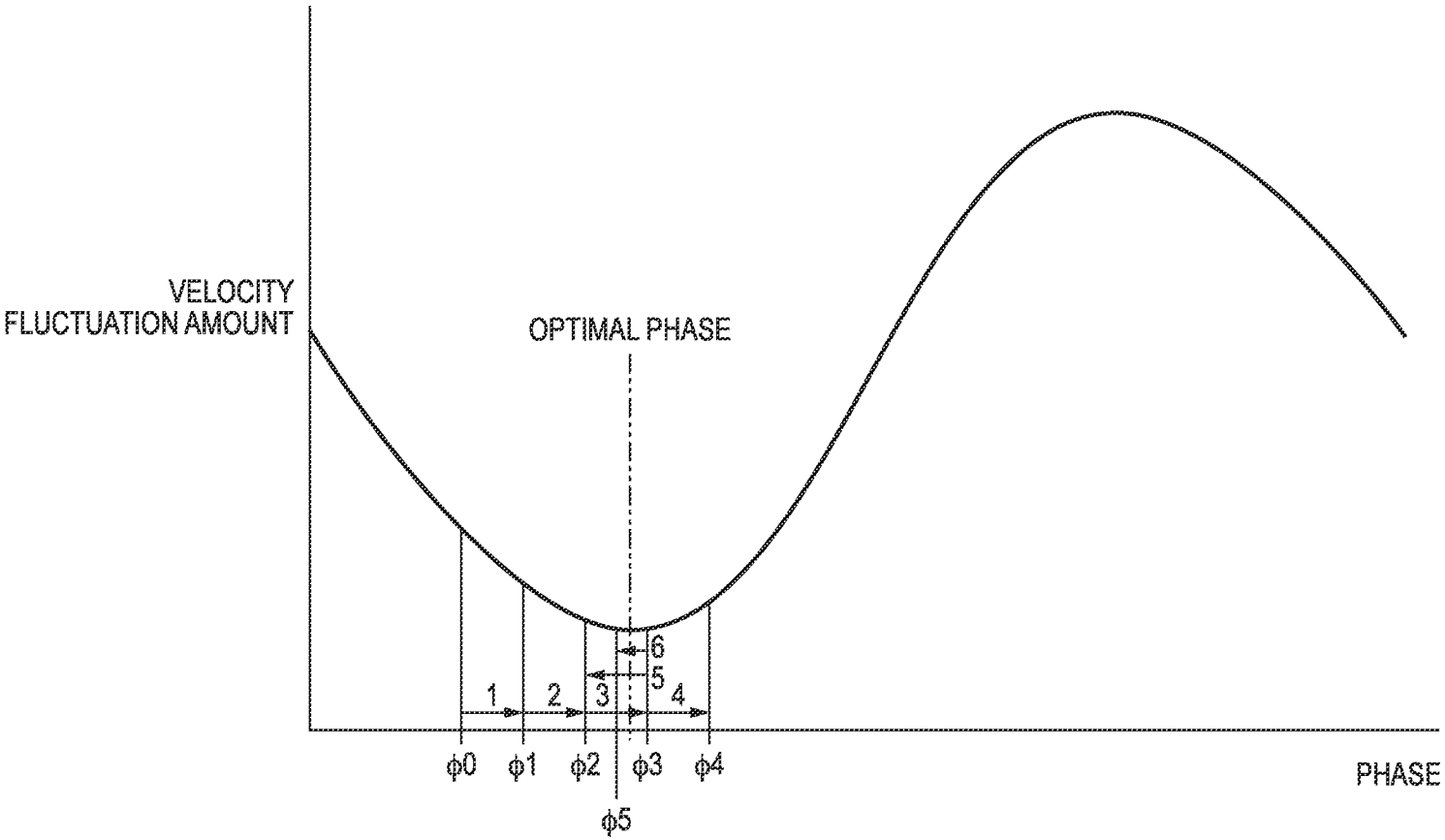
FIG. 12 is a graph exemplifying transition of the phase set value and current preferable value.

FIG. 12 exemplifies transition of the phase set value ϕn and current preferable value ϕs by the phase adjustment processing of FIG. 11. The phase ϕ0 is the initial value of the current preferable value ϕs. Both the phase set value ϕn and current preferable value ϕs are updated to ϕ→ϕ1→3. When the phase set value ϕn reaches ϕ4, the velocity fluctuation value increases. Hence, the current preferable value ϕs remains ϕ3, the sign of the adjustment value is reversed, and the next phase set value ϕn returns to ϕ2. Even in this case, since the velocity fluctuation value increases, the current preferable value ϕs remains ϕ3. The adjustment value decreases because the velocity fluctuation value has increased twice successively, and the phase set value ϕn is set to ϕ5. After that, the velocity fluctuation value decreases, so the current preferable value ϕs also becomes ϕ5. In this way, the phase comes close to an optimal one.

<Setting Example 3>

Figure 13:
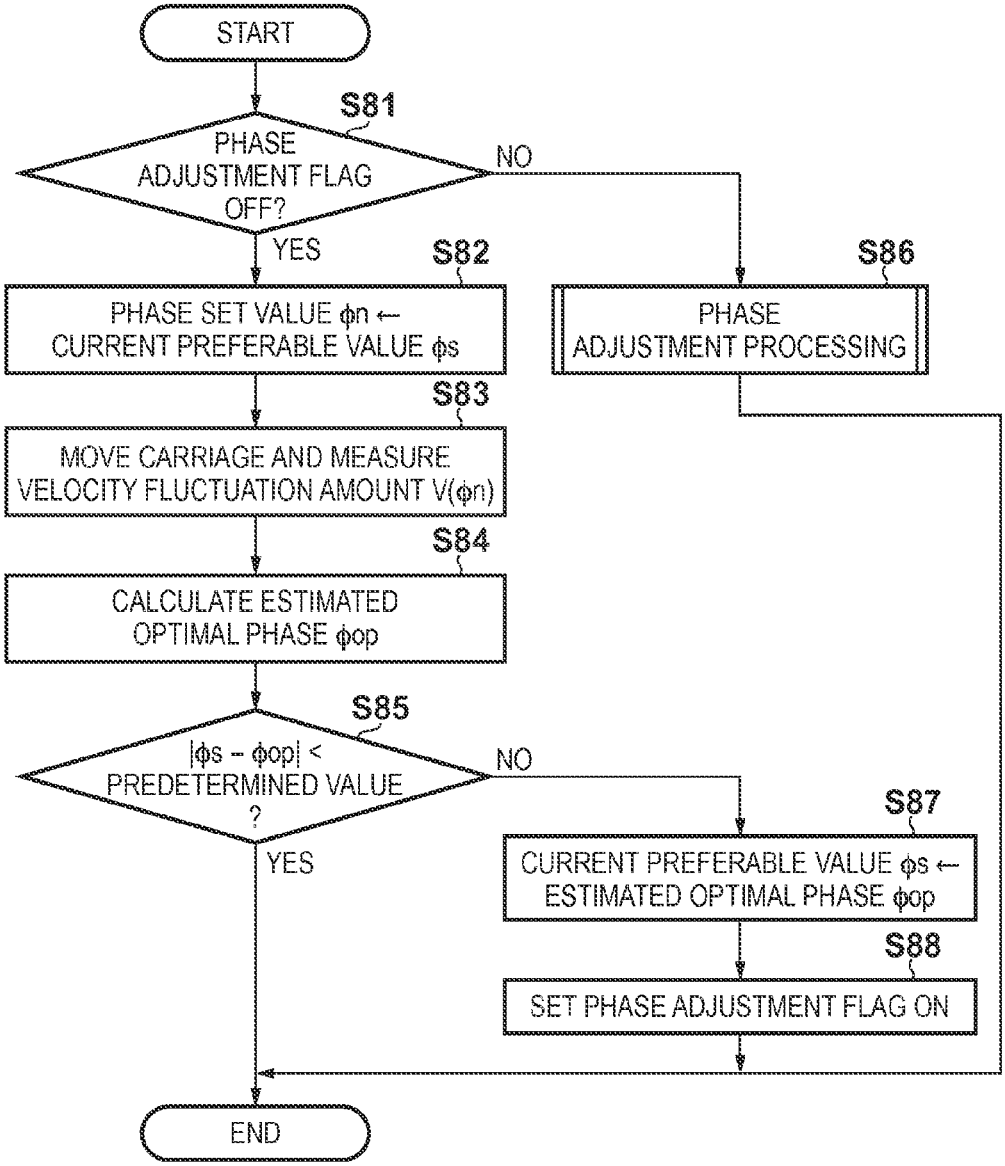
FIG. 13 is a flowchart showing another example of parameter setting processing.

In setting example 3, the amplitude A is fixed, and the phase ϕ is optimized. Setting example 3 aims particularly at quickly detecting a shift of the phase ϕ and optimizing the phase ϕ. In setting example 3, adjustment of the amplitude A is omitted from the contents of setting example 2. Since adjustment of the amplitude A is omitted, a shift of the phase ϕ can be quickly coped with. FIG. 13 is a flowchart of setting example 3. In setting example 3, every time the carriage 2 is scanned, processing in FIG. 13 is performed once to update the phase ϕ and its preferable value. A difference from setting example 1 will be explained. The meanings of the terms and application of examples, modifications, and the like are the same as those in setting examples 1 and 2, unless otherwise specified.

In step S81, it is determined whether the phase adjustment flag is OFF. If YES in step S81, the process advances to step S82; if NO, to step S86 to perform phase adjustment processing. The phase adjustment processing is the same as the processing exemplified in FIG. 11.

In step S82, the phase set value ϕn is set (setting of the next value). In this case, the current preferable values ϕs is set as the phase set value ϕn. In step S83, the carriage 2 is moved (scanned), and the velocity fluctuation amount V(ϕn) is measured from a velocity calculation result corresponding to the position at this time. In movement of the carriage 2, data for driving the carriage motor 7 is corrected based on correction data obtained by substituting the phase set value ϕn set in step S82 into equation (1). Then, the carriage 2 is moved from one end to the other of its moving range. The velocity calculation result corresponding to the position and the measurement value of the velocity fluctuation amount V(ϕn) are saved in, for example, the RAM 19.

In step S84, the estimated optimal phase ϕop is calculated based on the result of step S83. This processing is the same as that in step S4. In step S85, it is determined whether the difference (absolute value) between the current preferable value ϕs and the estimated optimal phase ϕop is smaller than a predetermined value (phase difference determination). This processing is the same as that in step S5. If the difference is smaller than the predetermined value, the processing for one unit ends. If the difference is equal to or larger than the predetermined value, it is considered that an abnormality such as tooth jumping of the driving unit DM has occurred, and the process advances to step S87. In step S87, the current preferable value ϕs is replaced with the estimated optimal phase ϕop. In step S88, the phase adjustment flag is set ON. Accordingly, the processing for one unit ends.

<Setting Example 4>

Figure 14:
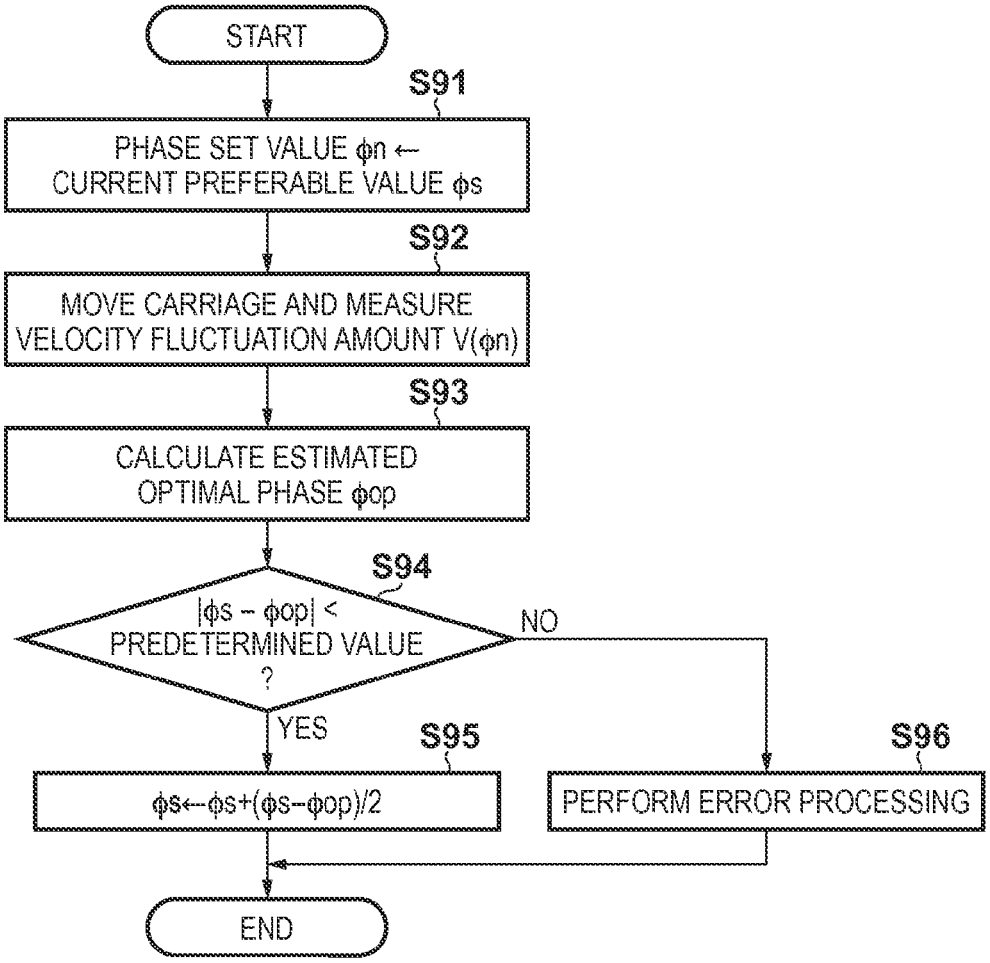
FIG. 14 is a flowchart showing another example of parameter setting processing.

In setting example 4, the amplitude A is fixed, and the phase ϕ is optimized. Setting example 4 aims particularly at always adjusting the phase ϕ to an optimal value. FIG. 14 is a flowchart of setting example 4. In setting example 4, every time the carriage 2 is scanned, processing in FIG. 14 is performed once to update the phase ϕ and its preferable value. A difference from setting example 1 will be explained. The meanings of the terms and application of examples, modifications, and the like are the same as those in setting example 1, unless otherwise specified.

In step S91, the phase set value $\phi n$ is set (setting of the next value). In this case, the current preferable values $\phi s$ is set as the phase set value $\phi n$. In step S92, the carriage 2 is moved (scanned), and the velocity fluctuation amount $V(\phi n)$ is measured from a velocity calculation result corresponding to the position at this time. In movement of the carriage 2, data for driving the carriage motor 7 is corrected based on correction data obtained by substituting the phase set value $\phi n$ set in step S91 into equation (1). Then, the carriage 2 is moved from one end to the other of its moving range. The velocity calculation result corresponding to the position and the measurement value of the velocity fluctuation amount $V(\phi n)$ are saved in, for example, the RAM 19.

In step S93, the estimated optimal phase $\phi op$ is calculated based on the result of step S92. This processing is the same as that in step S4. In step S94, it is determined whether the difference (absolute value) between the current preferable value $\phi s$ and the estimated optimal phase $\phi op$ is smaller than a predetermined value (phase difference determination). This processing is the same as that in step S5. If the difference is smaller than the predetermined value, the process advances to step S95; if the difference is equal to or larger than the predetermined value, it is considered that an abnormality such as tooth jumping of the driving unit DM has occurred, and the process advances to step S96. In step S96, error processing is performed. This processing is the same as that in step S18.

In step S94, the current preferable value $\phi s$ is updated to a new value by adding or subtracting, to or from the current preferable value $\phi s$, an adjustment value falling within the range of the difference between the current preferable value $\phi s$ and the estimated optimal phase $\phi op$. In this example, a ½ value of the difference (positive or negative) between the current preferable value $\phi s$ and the estimated optimal phase $\phi op$ is added. However, the present invention is not limited to this, and the value may be ⅓ or ¼. After that, the processing for one unit ends. In this setting example, the current preferable value $\phi s$ gradually comes close to the estimated optimal phase $\phi op$, and the phase $\phi$ can be always easily adjusted to an optimal value.

Other Embodiments

In setting examples 1 to 4, every time the carriage 2 is scanned once, each setting processing is executed. However, adjustment of the phase $\phi$ and amplitude A, and reflection of these parameters in correction data (setting of the current set values of the parameters) need not always be performed during the same scan. For example, only measurement of the velocity fluctuation amount may be performed during the print operation, and updating of the preferable values and reflection of the phase $\phi$ and amplitude A in correction data may be performed after the end of the print operation. In this case, determination of the preferable values and setting of the parameters may be performed based on the measurement result of a velocity fluctuation amount measured during an image print operation for one unit such as image printing of one page after the end of the image print operation for one unit.

The initial value of a preferable value may be set in advance before shipment of the printing apparatus A. Alternatively, processing of specifying the initial value may be automatically executed after shipment (after purchase by the user). In this case, the processing can be automatically executed when the printing apparatus A is turned on for the first time.

The above-described embodiment is applied to a printing apparatus. However, the application field of the present invention is not limited to this, and the present invention is applicable to various driving apparatuses in which a moving member is moved by a driving unit using a motor as a driving source.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2012-015926, filed Jan. 27, 2012, which is hereby incorporated by reference herein in its entirety.

What is claimed is:

1. A control method of a printing apparatus including a carriage mounting a printhead and a motor as a driving source for moving the carriage, the control method comprising:

controlling driving of the motor to reciprocate the carriage in a print processing;

measuring a velocity fluctuation of the carriage;

correcting driving of the motor by correction data to reduce a velocity fluctuation of the carriage arising from cogging of the motor; and updating a parameter which defines a periodic fluctuation manner of the correction data in the print processing, wherein the updating the parameter in the print processing comprises determining a current preferable value of the parameter based on the measured velocity fluctuation regarding a current set value of the parameter, and setting a next set value of the parameter for a next movement of the carriage from the determined preferable value.

2. The method according to claim 1, wherein the updating the parameter in the print processing comprises setting, as the preferable value, a set value smaller in velocity fluctuation based on the measurement out of the current set value and a previous set value of the parameter, and adding or subtracting an adjustment value to or from the preferable value to set the next set value of the parameter.

3. The method according to claim 2, wherein the updating the parameter in the print processing comprises not switching addition and subtraction of the adjustment value when the set value smaller in velocity fluctuation based on the measurement is the current set value, and switching addition and subtraction of the adjustment value when the set value smaller in velocity fluctuation based on the measurement is the previous set value.

4. The method according to claim 3, wherein when the set value smaller in velocity fluctuation based on the measurement is the previous set value a plurality of times successively, the adjustment value is decreased.

5. The method apparatus to claim 1, wherein the parameter includes at least a phase, and the updating the parameter in the print processing comprises:

based on the measured velocity fluctuation for a case in which the correcting is not performed, and the velocity fluctuation for a current set value of the phase, calculating an estimated optimal phase for reducing the velocity fluctuation of the carriage, performing phase difference determination to determine whether a phase difference between the preferable value of the phase and the estimated optimal phase is not smaller than a predetermined value, and when the phase difference is not smaller than the predetermined value as a result of the phase difference determination, setting the preferable value of the phase as the estimated optimal phase and also as the next set value of the phase.

6. The method according to claim 5, wherein the updating the parameter in the print processing comprises:

when the phase difference is not smaller than the predetermined value as a result of the phase difference determination in a previous setting, based on the measured velocity fluctuation measured for the case in which the correcting is not performed, and the velocity fluctuation for the estimated optimal phase serving as the current set value of the phase, calculating a new estimated optimal phase for reducing the velocity fluctuation of the carriage, and when the phase difference between the estimated optimal phase serving as the current set value of the phase and the new estimated optimal phase is smaller than the predetermined value, setting the next set value of the phase by adding or subtracting the adjustment value to or from the estimated optimal phase serving as the current set value of the phase.

7. The method according to claim 6, wherein the updating the parameter in the print processing comprises:

when the phase difference between the estimated optimal phase serving as the current set value of the phase and the new estimated optimal phase is not smaller than the predetermined value, performing error processing.

8. The method according to claim 1, wherein the parameter includes an amplitude and a phase, and the updating the parameter in the print processing comprises:

performing phase adjustment processing in which a set value of the amplitude is fixed and a set value of the phase is adjusted, and after the phase adjustment processing, performing amplitude adjustment processing in which the set value of the phase is fixed and the set value of the amplitude is adjusted.

9. The method according to claim 8, wherein based on the measured velocity fluctuation measured for a case of not performing correction, and the velocity fluctuation for a current set value of the phase, calculating an estimated optimal phase for reducing the velocity fluctuation of the carriage, performing phase difference determination to determine whether a phase difference between the preferable value of the phase and the estimated optimal phase is smaller than a predetermined value, when the phase difference is smaller than the predetermined value as a result of the phase difference determination, keeping unchanged the preferable value of the phase, and setting the preferable value of the phase as a next set value of the phase, and when the phase difference is smaller than the predetermined value a plurality of times successively as a result of the phase difference determination, performing the amplitude adjustment processing.

10. The method according to claim 1, wherein the parameter includes at least a phase, the updating the parameter in the print processing comprises based on the measured velocity fluctuation measured for a case in which the correcting is not performed and the velocity fluctuation for the current set value, calculating an estimated optimal phase for reducing the velocity fluctuation of the carriage, and setting, as a new preferable value, a value obtained by adding or subtracting, to or from the preferable value of the phase, an adjustment value falling within a range of a difference between the preferable value of the phase and the estimated optimal phase, and setting the preferable value as the next set value of the phase.

11. The method according to claim 10, wherein the updating the parameter in the print processing comprises setting, as the preferable value, a value obtained by adding or subtracting, to or from the current set value of the phase, a ½ adjustment value of a difference between the current set value of the phase and the estimated optimal phase.

12. The method according to claim 1, wherein the updating the parameter in the print processing comprises setting the parameter in each printing scan of the carriage among a plurality of successive printing scans.

13. The method according to claim 1, wherein the updating the parameter in the print processing comprises, based on a measurement result of a velocity fluctuation amount during a print operation for one unit of an image, performing determination of the preferable value and setting of the next set value after an end of the image print operation for one unit of an image.

14. The method according to claim 1, further comprising detecting a position of the carriage with a linear encoder, wherein the velocity fluctuation is measured based on a signal detected by the linear encoder.

15. A driving control method of a motor, comprising:

controlling driving of the motor to move a moving member during a predetermined operation;

acquiring a velocity fluctuation of the moving member;

correcting driving of the motor by correction data to reduce a velocity fluctuation of the moving member arising from cogging of the motor; and updating a parameter which defines a periodic fluctuation manner of the correction data in the predetermined operation, wherein the predetermined operation is not a test operation, and in the updating the parameter in the predetermined operation, a current preferable value of the parameter is determined based on the velocity fluctuation acquired for a current set value of the parameter, and a next set value of the parameter for a next movement of the moving member is set from the determined preferable value.

* * * * *